US007946357B2

(12) United States Patent
Trinh et al.

(10) Patent No.: US 7,946,357 B2
(45) Date of Patent: May 24, 2011

(54) DRILL BIT WITH A SENSOR FOR ESTIMATING RATE OF PENETRATION AND APPARATUS FOR USING SAME

(75) Inventors: Tu Tien Trinh, Houston, TX (US); Eric Sullivan, Houston, TX (US); Daryl Pritchard, Shenandoah, TX (US)

(73) Assignee: Baker Hughes Incorporated, Houston, TX (US)

( * ) Notice: Subject to any disclaimer, the term of this patent is extended or adjusted under 35 U.S.C. 154(b) by 352 days.

(21) Appl. No.: 12/193,332

(22) Filed: Aug. 18, 2008

(65) Prior Publication Data

US 2010/0038136 A1 Feb. 18, 2010

(51) Int. Cl.
*E21B 49/00* (2006.01)

(52) U.S. Cl. ..... 175/50; 175/40

(58) Field of Classification Search ..... 166/255.2, 166/177.1, 177.2; 175/40, 50; 367/81, 83
See application file for complete search history.

(56) References Cited

U.S. PATENT DOCUMENTS 5,415,030 A 5/1995 Jogi et al.
5,448,227 A 9/1995 Orban et al.
5,475,309 A 12/1995 Hong et al.
5,720,355 A 2/1998 Lamine et al.
6,057,784 A 5/2000 Schaaf et al.
6,150,822 A 11/2000 Hong et al.
6,230,822 B1 5/2001 Sullivan et al.
6,419,032 B1 7/2002 Sullivan et al.
6,540,033 B1 4/2003 Sullivan et al.
6,543,312 B2 4/2003 Sullivan et al.
6,564,883 B2 5/2003 Fredericks et al.
6,571,886 B1 6/2003 Sullivan et al.
6,626,251 B1 9/2003 Sullivan et al.
6,769,497 B2 8/2004 Dubinsky et al.
6,850,068 B2 2/2005 Chemali et al.
7,046,165 B2 5/2006 Beique et al.
7,058,512 B2 6/2006 Downton
7,066,280 B2 6/2006 Sullivan et al.
7,168,506 B2 * 1/2007 Boucher et al. ..... 175/48
7,207,215 B2 4/2007 Spross et al.
7,278,499 B2 10/2007 Richert et al.
7,301,223 B2 * 11/2007 Rodney et al. ..... 257/629
7,308,937 B2 12/2007 Radford et al.
7,350,568 B2 4/2008 Mandal et al.
7,387,177 B2 6/2008 Zahradnik et al.
7,497,276 B2 3/2009 Pastusek et al.
7,506,695 B2 3/2009 Pastusek et al.
7,510,026 B2 3/2009 Pastusek et al.
(Continued)

OTHER PUBLICATIONS

Dateline Los Almos, a Monthly Publication of Los Almos National Laboratory, Jan. Issue 1997, pp. 1-8.

(Continued)

*Primary Examiner* — Daniel P Stephenson
(74) *Attorney, Agent, or Firm* — Cantor Colburn LLP

(57) ABSTRACT

In one embodiment, an apparatus includes a drill bit, a tip on a bit body configured to contact a formation when the drill bit is utilized to cut into the formation, and a spring coupled to the tip. The apparatus also includes a sensor coupled to the spring and configured to provide signals corresponding to the displacement of the tip when the tip is in contact with the formation.

19 Claims, 3 Drawing Sheets

U.S. PATENT DOCUMENTS

| | | | | |
|---|---|---|---|---|
| 2001/0054514 | A1 | 12/2001 | Sullivan et al. | |
| 2004/0069539 | A1 | 4/2004 | Sullivan et al. | |
| 2004/0222018 | A1 | 11/2004 | Sullivan et al. | |
| 2007/0092995 | A1* | 4/2007 | Datta et al. | 438/108 |
| 2008/0060848 | A1 | 3/2008 | Pastusek et al. | |
| 2008/0065331 | A1 | 3/2008 | Pastusek et al. | |
| 2008/0066959 | A1 | 3/2008 | Pastusek et al. | |
| 2008/0164062 | A1* | 7/2008 | Brackin et al. | 175/24 |
| 2010/0006338 | A1* | 1/2010 | Desai | 175/27 |
| 2010/0083801 | A1* | 4/2010 | Li et al. | 83/13 |

OTHER PUBLICATIONS

Semiconductor-Based Radiation Detectors, http://sensors.lbl.gov/sn_semi.html, pp. 1-5.

NETL: Oil & Natural Gas Projects, Harsh-Environment Solid-State Gamma Detector for Down-hole Gas and Oil Exploration, http://www.netl.doe.gov/technologies/oil-gas/NaturalGas/Projects_n/ . . . , pp. 1-5.

XRF Corporation, About CZT Detectors, http://xrfcorp.com/technology/about_czt_detectors.html, 1 sheet.

* cited by examiner $k_S$ (spring stiffnes) < $k_f$ (formation stiffness)

$x = F/k$ $ROP = dx/dt$

DRILL BIT WITH A SENSOR FOR ESTIMATING RATE OF PENETRATION AND APPARATUS FOR USING SAME

BACKGROUND INFORMATION

1. Field of the Disclosure

This disclosure relates generally to drill bits including sensors for providing measurements for a property of interest and systems using such drill bits.

2. Brief Description of the Related Art

Oil wells (wellbores or boreholes) are drilled with a drill string that includes a tubular member having a drilling assembly (also referred to as the bottomhole assembly or "BHA") that has a drill bit attached to the bottom end of the BHA. The drill bit is rotated to disintegrate the earth formations to drill the wellbore. The BHA typically includes devices for providing information about parameters relating to the behavior of the BHA, parameters of the formation surrounding the wellbore and parameters relating to the drilling operations. One such parameter is the rate of penetration (ROP) of the drill bit into the formation.

A high ROP is desirable because it reduces the overall time required for drilling a wellbore. ROP depends on several factors which include the design of the drill bit, rotational speed (or rotations per minute or (RPM) of the drill bit, weight-on-bit type of the drilling fluid being circulated through the wellbore and the rock formation. A low ROP typically extends the life of the drill bit and the BHA. The drilling operators attempt to control the ROP and other drilling and drill sting parameters to obtain a combination of parameters that will provide the most effective drilling environment. ROP is typically determined based on devices disposed in the BHA and at the surface. Such determinations can often differ from the actual ROP. Therefore, it is desirable to provide an improved apparatus and methods for determining or estimating the ROP.

SUMMARY

In one aspect, a drill bit is disclosed that includes a sensor proximate to a cutter of the drill bit to provide signals relating to displacement of the cutter during drilling of a wellbore. In one aspect, the sensor may include a piezoelectric member that generates electrical signals corresponding to the displacement of the cutter. In another aspect, the output of the sensor may be coupled to an electrical circuit that digitizes the signals from the sensor. In another aspect, a system is disclosed that includes the drill bit with the displacement sensor and a processor configured to process the digitized signal and compute ROP during drilling of a wellbore. The system may further include a telemetry unit that transmits information relating to the ROP to a surface control unit, which may control one or more operations of a BHA in response to the ROP information. In another aspect, the ROP may be utilized by a controller in a BHA to control an operation of the BHA.

Examples of certain features of a drill bit having a displacement sensor and a system for using such a drill bit are summarized rather broadly in order that the detailed description thereof that follows may be better understood. There are, of course, additional features of the drill bit and systems for using the same disclosed hereinafter that form the subject of the claims appended hereto.

BRIEF DESCRIPTION OF THE DRAWINGS

For detailed understanding of the present disclosure, references should be made to the following detailed description, taken in conjunction with the accompanying drawings in which like elements have generally been designated with like numerals and wherein.

DETAILED DESCRIPTION

Figure 1:
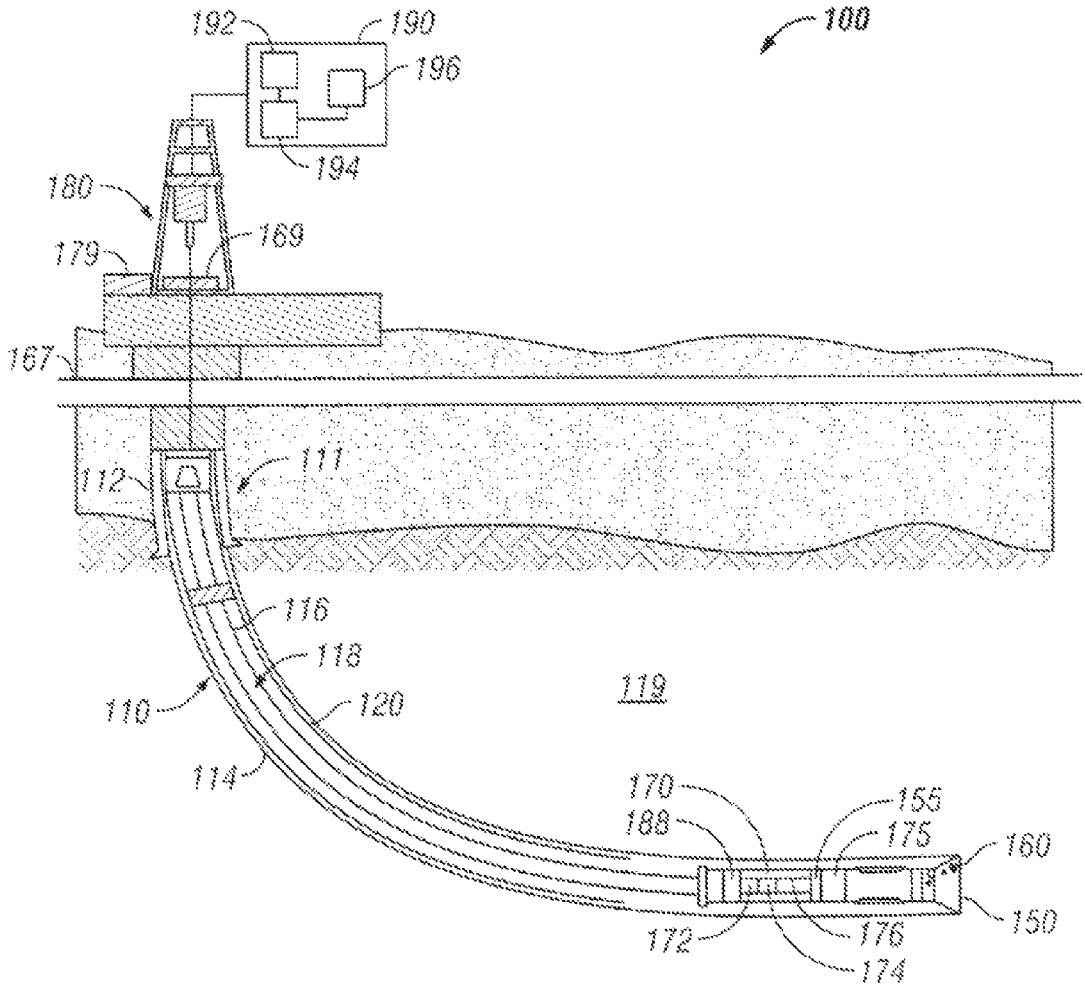
FIG. 1 is a schematic diagram of a wellbore system that includes a drill string having a drill bit made according to one embodiment of the disclosure.

FIG. 1 is a schematic diagram of an exemplary drilling system 100 that may utilize drill bits disclosed herein for drilling wellbores. FIG. 1 shows a wellbore 110 that includes an upper section 111 with a casing 112 installed therein and a lower section 114 being drilled with a drill string 118. The drill string 118 is shown to include a tubular member 116 that carries a bottomhole assembly (BHA) 130 at its bottom end. The tubular member 116 may be made up by joining drill pipe sections or it may be a coiled-tubing. A drill bit 150 is attached to the bottom end of the BHA 130 to disintegrate rocks in the earth formation to drill the wellbore 110.

The drill string 118 is conveyed into the wellbore 110 from a rig 180 at the surface 167. The rig 180 shown is a land rig for ease of explanation. The apparatus and methods disclosed herein may also be utilized when an offshore rig (not shown) is used for drilling a wellbore under water. A rotary table 169 or a top drive (not shown) coupled to the drill string 118 may be utilized to rotate the drill string 118 at the surface to rotate the BHA and thus the drill bit 150 to drill the wellbore 110. A drilling motor 155 (also referred to as "mud motor") in the drilling assembly may be utilized alone to rotate the drill bit or to superimpose the drill bit rotation by the rotary table 169. A control unit (or "controller") 190, which may be a computer-based unit, may be placed at the surface for receiving and processing data transmitted by the sensors in the drill bit and sensors in the BHA 130 and for controlling selected operations of the various devices and sensors in the BHA 130. The surface controller 190, in one embodiment, may include a processor 192, a data storage device (or "computer-readable medium") 194 for storing data and computer programs 196. The data storage device 194 may be any suitable device, including, but not limited to, a read-only memory (ROM), random-access memory (RAM), flash memory, magnetic tape, hard disc and an optical disk. During drilling, a drilling fluid from a source thereof 179 is pumped under pressure through the tubular member 116, which fluid discharges at the bottom of the drill bit 150 and returns to the surface via the annular space (also referred as the "annulus") between the drill string 118 and the inside wall of the wellbore 110.

Figure 2:
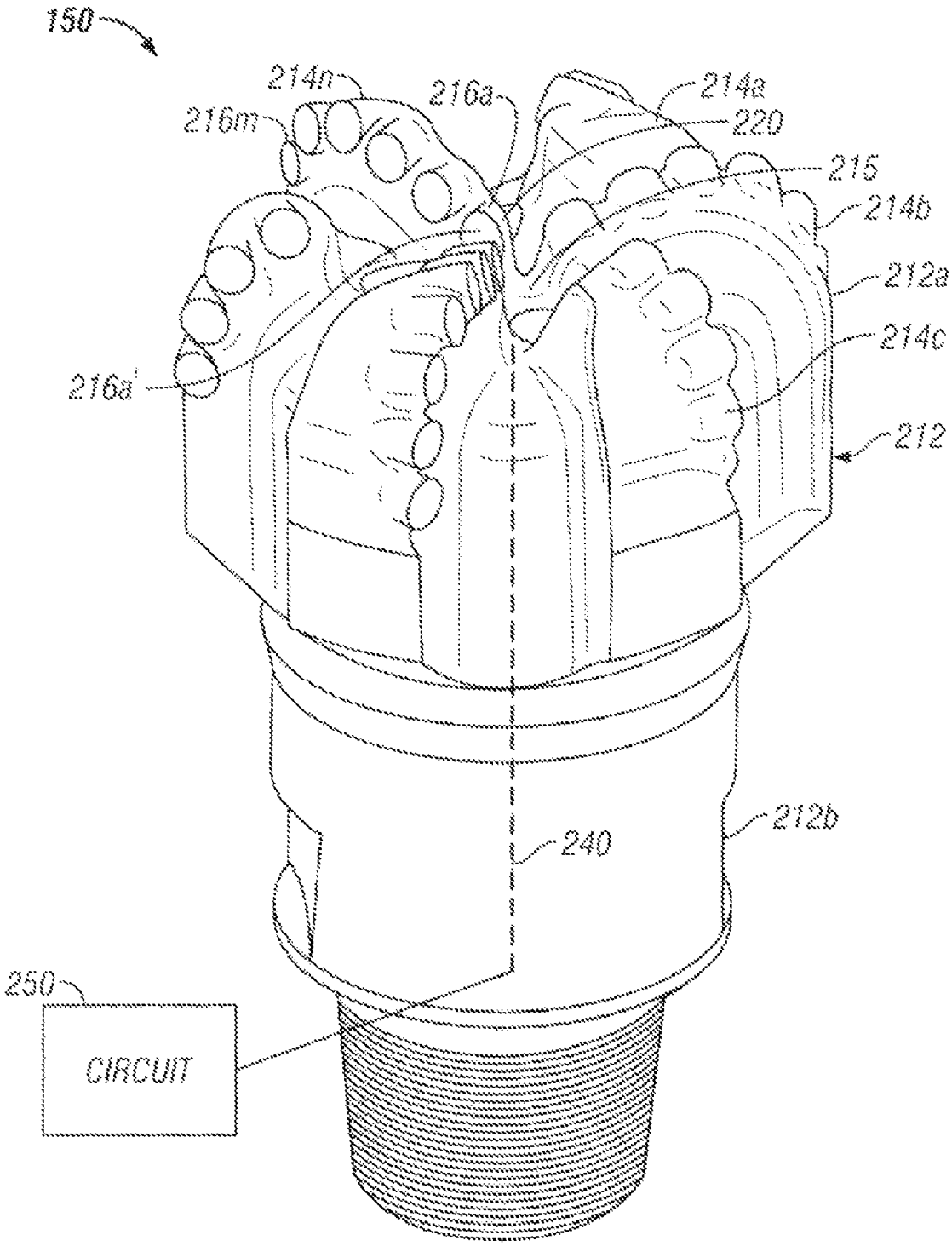
FIG. 2 is an isometric view of an exemplary drill bit showing placement of a displacement sensor proximate to a cutter of the drill bit and an electrical circuit that may process signals generated by the displacement sensor according to one embodiment of the disclosure.
Figure 3:
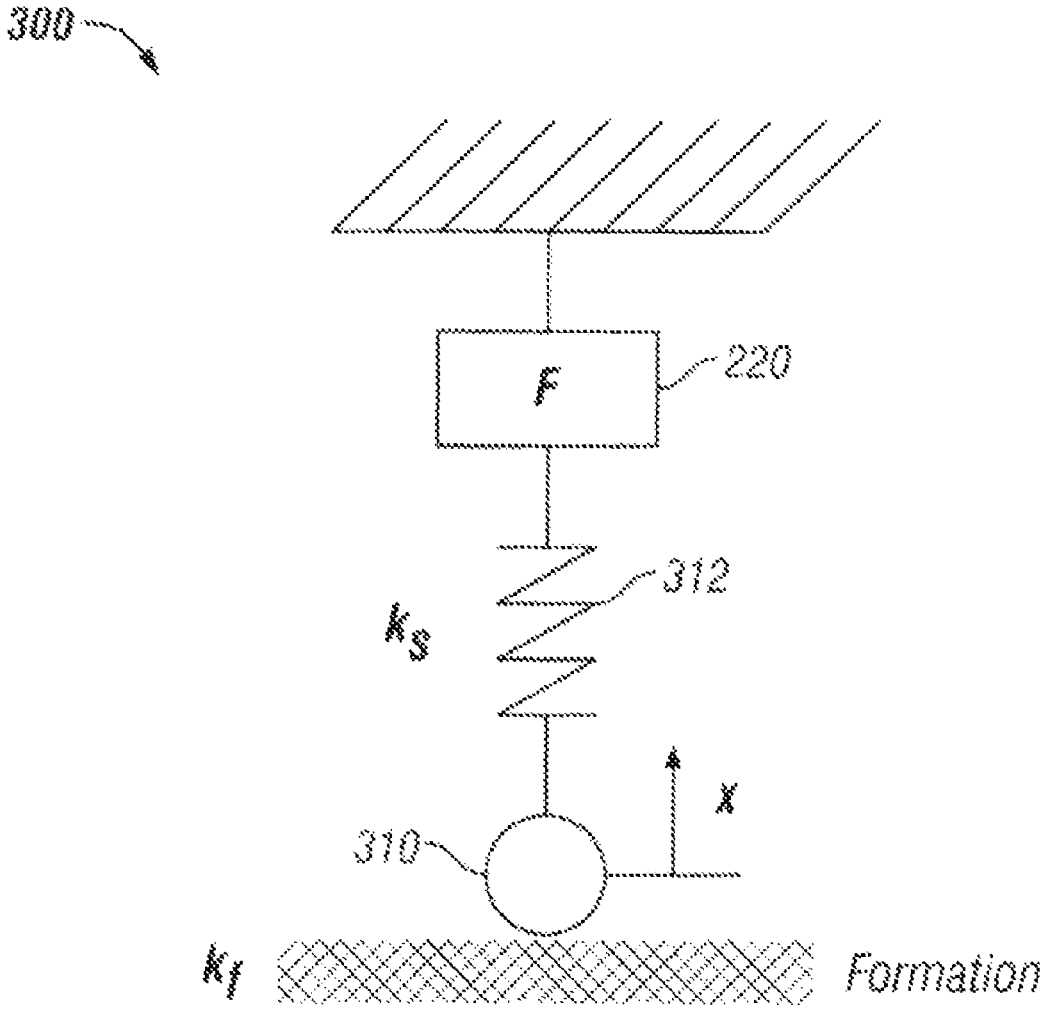
FIG. 3 is a schematic diagram showing the relative placement of the drill bit cutter, a spring and the displacement sensor in the drill bit.

Still referring to FIG. 1, the drill bit 150 may include one or more sensors 160 and may also include circuitry for processing signals from such sensors and for estimating one or more parameters relating to the drill bit 150 during drilling of the wellbore 110, as described in more detail in reference to FIGS. 2 and 3. The BHA 130 further may include one or more downhole sensors (also referred to as the measurement-while-drilling (MWD) sensors), collectively designated herein by numeral 175, and at least one control unit (or controller) 170 for processing data received from the MWD sensors 175 and the drill bit 150. The controller 170 may include a processor 172, such as a microprocessor, a data storage device 174 and programs 176 for use by the processor 172 to process downhole data and to communicate with the surface controller 190 via a two-way telemetry unit 188.

FIG. 2 shows an isometric view of an exemplary PDC drill bit 200 that is shown to include a sensor 220 for obtaining measurements relating to ROP of the drill bit 200 and certain circuits for processing at least partially the signals generated by such sensor. A PDC drill bit is shown for the purpose of explanation only. Any other type of drill bit, however, may be utilized for the purpose of this disclosure. The drill bit 200 is shown to include a bit body 212 that comprises a crown 212*a* and a shank 212*b*. The crown 212*a* is shown to include a number of profiles 214*a*, 214*b*, . . . 214*n*. All profiles terminate at bottom center 215 of the drill bit 200. A number of cutters are shown placed along each profile. For example, profile 214*a* is shown to contain cutters 216*a*-216*m*. Each cutter has a cutting element, such as the element 216*a*' corresponding to the cutter 216*a*. Each cutting surface engages the rock formation when the drill bit is rotated to drill the wellbore. Each cutter has a back rake angle and a side rake angle that defines the cut made by that cutter into the formation.

Still referring to FIG. 2, a sensor 220 may be placed between the cutting element 216*a*' and the drill bit body for providing signals corresponding to the force applied by the cutter 216*a* on the formation. In one aspect, the sensor 220 may be attached at the back of the cutter that is closest to the drill bit center 215. The sensor 220, in one aspect, may be a piezoelectric sensor that provides signals by any suitable mechanism, including but not limited to brazing and screws responsive to the reactive force on the cutter 216*a* during drilling of the wellbore. Signals from the sensor 220 may be provided via conductors 240 to a circuit 250 placed in the drill bit shank 212*b*. In one aspect, the circuit 250 may be configured to amplify the analog signals received from the sensor 220, digitize the amplified signals and transmit the digitized signals to the controller 170 in the BHA 130 for further processing. In one aspect, the processor 172 in the controller 170 process the sensor signals and may estimate the instantaneous ROP there from using programs 176 stored in the storage device 174 and/or instructions provided from the surface by controller 190.

FIG. 3 shows a model (or an equivalent circuit) 300 relating to the operation of the sensor 220 in the drill bit. The model 300 shows a tip 310 against the formation that has a stiffness Kf, a spring 312 defining the stiffness K of the sensor 220, the sensor element 220 that produces voltage signals responsive to the force F applied by the tip 310 on the formation. The tip 310 may be the cutter 216*a*, a dull polycrystalline diamond member or a suitable blunt tip that is configured to engage the formation during drilling of a wellbore. The stiffness K of the sensor 220 is set below the stiffness of the formation through which the drill bit 150 is expected to drill. A single drill bit usually drills through formations with differing values of stiffness. In such cases, the stiffness K is chosen to be less than the stiffness of the formation having the least stiffness.

During drilling operations, the drill string applies a predetermined load or weight-on-bit (WOB). The rotational speed (revolutions per minute (RPM)) of the drill bit, WOB, and the rock formation type are some of the parameters that define the rate of penetration (ROP) of the drill bit into the formation. However, the displacement sensor 220 provides signals corresponding to the displacement of the tip 310, which in turn corresponds to the reactive force on the tip 310 during drilling through the formation. The reactive force is based on the depth of cut into the formation. For a given RPM and WOB, the depth of cut will be larger in a soft formation than in a hard formation. Therefore, the reactive force on the tip 310 will be greater in the soft formation than the hard formation, which means that for the same WOB and RPM, the ROP in a soft formation will be greater than in a hard formation. This implies that the reactive force on the tip will correspond to the ROP, substantially independent of the formation, WOB and RPM.

Still referring to FIG. 3, the instantaneous ROP during drilling may be calculated by determining change of distance over a change of time (also referred to as the time period). The change of time may be determined from the sampling frequency of the signals provided by the sensor 220. For example, if the signal from the sensor 220 is sampled at a frequency of "F" Hz, the time period will equal 1/F seconds. Thus, for example, if the sampling frequency F is 100 Hz, the time period "Δt" will be 1/100 second. The distance of the tip or the cutting depth "x" may be derived from $x=F/k$, where F is the force measured by the sensor 220 and k is the stiffness of the spring 312. The change of distance "Δx" of the cutter be derived from $\Delta x=x(n)-x(n-1)/\Delta t$, where x(n) is the $n^{th}$ distance and x(n−1) is the distance preceding the $n^{th}$ distance. The ROP is then defined as the rate of change of distance over the rate of change of time, i.e., $ROP=dx/dt=\Delta x/\Delta t$. In another aspect, a series of ROP measurements may be averaged to obtain the instantaneous ROP.

Thus, the signals produced by the sensor 220 on the drill bit correspond to the displacement of the tip 310, which in turn corresponds to the reactive force on the tip 310. The instantaneous ROP may then be estimated using the force measurements and the sampling frequency. In another aspect, the force measurements of the sensor 220 may be calibrated at the surface to obtain a relationship between the force applied on the tip 310 measurements and the ROP. To calibrate the sensor 220, tests may be made at the surface in which known forces are exerted on the tip and corresponding voltage signals generated by the sensor 220 are recorded. The recorded sensor signals are then correlated to the ROP. The relationship between the sensor output signals and the ROP may be stored in a curve form or recoded in a tabular form. Such data may be stored in the downhole storage device 174 and/or the surface storage device 194.

In operation, the signals from the sensor 220 may be processed by the downhole processor 172 to estimate (or calculate) the instantaneous ROP. Alternatively, the sensor signals may be sent to the surface processor 192 for estimating the instantaneous ROP. Also, the sensor signals may be partially processed downhole and partially at the surface. The determined instantaneous ROP data may be provided in a form suitable for an operator to take one or more actions to control the drilling operations. Alternatively or in addition thereto, the downhole processor 172 may take one or more actions using the programmed instructions stored in the storage device 174 or sent from the surface controller 190. The actions taken may include, but, are not limited to, altering the RPM of the drill bit, altering the WOB and altering the drilling direction.

Thus in one aspect, an apparatus made according to one embodiment may include: a drill bit having a tip placed on the drill bit body, the tip being configured to be in contact with a formation when the drill bit is utilized to drill into a formation, a sensor that is configured to provide signals corresponding to the force applied by the tip on the formation when the cutter is used for drilling into the formation. The apparatus may further include a circuit that digitizes the signals from the sensor. A processor associated with the sensor may be configured to process the digitized signals to estimate an instantaneous ROP. The tip may be a metallic member attached to the bit body or it may be a cutter on the drill body that cuts into the formation when used for drilling into the formation. In one aspect, the sensor may be embedded in the drill bit body proximate to or juxtaposed to the tip. In one aspect, the sensor may be a piezoelectric sensor that generates a voltage signal in response to a reactive force on the tip. Any suitable sensor that provides a signal responsive to the reactive force on the tip or the cutter may be utilized for the purpose of this disclosure. The sensor may be attached to the tip by any suitable mechanism, including, but not limited to using brazing and screws.

In another aspect, a system made according to one embodiment of the disclosure may include a bottomhole assembly (BHA) with a drill bit attached to the bottom end thereof, which system may further include a sensor placed proximate a cutter of the drill bit to provide signals corresponding to the force applied by the cutter on a formation. The system may further include a processor that processes the signals from the sensor to estimate an instantaneous ROP of the drill bit into the formation during drilling of a wellbore by the BHA. The processor may be placed in the BHA or at a surface. The system may further include correlation data stored in a computer-readable medium or device accessible to the processor that provides a correlation of the force signals generated by the sensor and the ROP.

The foregoing description is directed to particular embodiments for the purpose of illustration and explanation. It will be apparent, however, to persons skilled in the art that many modifications and changes to the embodiments set forth above may be made without departing from the scope and spirit of the embodiments disclosed herein. It is intended that the following claims be interpreted to embrace all such modifications and changes.

The invention claimed is:

1. A drill bit, comprising:

a bit body;

a member on the bit body configured to contact a formation when the drill bit is utilized to cut into a formation; and a sensor coupled to the member that is configured to provide signals corresponding to displacement of the member when the member is in contact with the formation, the sensor comprising a material having a stiffness less than a stiffness of the formation.

2. The drill bit of claim 1, wherein the member is a cutter attached to the bit body.

3. The drill bit of claim 2, wherein the sensor is attached to the member.

4. The drill bit of claim 1, wherein the sensor includes piezoelectric element that provides voltage signals corresponding to the displacement of the member.

5. The drill bit of claim 1 further comprising a circuit configured to digitize the signals provided by the sensor.

6. The apparatus of claim 5 further comprising a processor configured to process the digitized signals to estimate a rate of penetration of the drill bit.

7. The apparatus of claim 6, wherein the processor is further configured to estimate the rate of penetration using data that correlates force exerted by the member on the formation and the rate of penetration.

8. The apparatus of claim 5, further comprising a processor that is configured to process the digitized signals to estimate a hardness of the formation.

9. A bottomhole assembly for use in drilling a wellbore in a formation, comprising:

a drill bit having a bit body that includes a tip that is configured to contact the formation when the drill bit is utilized to cut into the formation and a sensor coupled to the tip to provide signals corresponding to displacement of the tip when the tip is in contact with the formation, the sensor comprising a material having a stiffness less than a stiffness of the formation; and a processor configured to process signals from the sensor to provide an estimate of rate of penetration of the drill bit into the formation.

10. The bottomhole assembly of claim 9, wherein the tip is a cutter on the bit body that has a cutting face configured to cut into the formation and wherein the sensor is placed between the cutting element and the bit body.

11. The bottomhole assembly of claim 9, wherein the sensor is a piezoelectric sensor that provides voltage signals corresponding to the displacement of the cutting element.

12. The bottomhole assembly of claim 9 wherein the sensor comprises a spring between the bit body and the tip, the spring having the material with the stiffness less than the stiffness of the formation.

13. The bottomhole assembly of claim 9 further comprising a circuit configured to digitize signals provided by the sensor.

14. The bottomhole assembly of claim 13, wherein the processor is further configured to estimate the rate of penetration using data that correlates force on the tip and the rate of penetration.

15. The bottomhole assembly of claim 13, wherein the processor configured to process signals from the sensor to provide an estimate of a hardness of the formation.

16. The bottomhole assembly of claim 9, wherein the processor is placed at one of: a location in the bottomhole assembly, a surface location, and partially in the bottomhole assembly and partially at the surface.

17. A method of making a drill bit, comprising:

providing a bit body that has a tip on the bit body, the tip member being configured to contact a formation when the drill bit is used for cutting into the formation; and coupling a sensor to the tip in a manner that will generate signals in response to displacement of the tip when the drill bit is used for cutting into the formation, the sensor comprising a material having a stiffness less than a stiffness of the formation.

18. The method of claim 17 wherein coupling the sensor comprises attaching the sensor to the tip.

19. The method of claim 17 further comprising providing a circuit in bit body configured to at least partially process the signals generated by the sensor.

* * * * *